United States Patent [19]

Holden-Parker

[11] 4,428,532

[45] Jan. 31, 1984

[54] SPRAY APPARATUS

[76] Inventor: Gary Holden-Parker, "Louvain", Quavey Road,, Redlynch, Wiltshire, England

[21] Appl. No.: 328,614

[22] Filed: Dec. 8, 1981

[51] Int. Cl.[3] ..... B05B 15/10

[52] U.S. Cl. ..... 239/204; 239/207; 239/208; 239/282

[58] Field of Search ..... 239/200, 201, 203, 204, 239/207, 208, 282, 273, 264, 120, 121

[56] References Cited

U.S. PATENT DOCUMENTS

| | | | |
|---|---|---|---|
| 2,086,724 | 7/1937 | McAulay | 239/273 |
| 2,983,451 | 5/1961 | Ramsey | 239/203 |
| 3,009,648 | 11/1961 | Hait | 239/201 |

FOREIGN PATENT DOCUMENTS

| | | | |
|---|---|---|---|
| 2063711 | 6/1981 | United Kingdom | 239/208 |

*Primary Examiner*—John J. Love

*Assistant Examiner*—Mary McCarthy

*Attorney, Agent, or Firm*—Maky, Renner, Otto & Boisselle

[57] ABSTRACT

This invention relates to spray apparatus for spraying water onto the ground or floor of an indoor riding arena having outwardly inclined boards provided around its periphery, said boards having mounted on their rear side a spray or sprinkler unit which is pivotally mounted by a mounting, the unit being located within a housing which can move with the unit from an inoperative position in which the unit and housing are retracted towards an operative position in which the unit and housing protrude from the front surface of a said board and the spray unit protrudes from the housing, the unit and housing being biassed towards the inoperative position by a weight and moved towards the operative position by a piston and cylinder device which is supplied with water under pressure from the supply conduit for the unit.

11 Claims, 2 Drawing Figures

SPRAY APPARATUS

BACKGROUND OF THE INVENTION

This invention relates to spray apparatus and particularly but not exclusively to spray apparatus for spraying water onto the ground or floor area of an arena, such as an indoor horse riding arena.

The ground or floor area of an indoor horse riding arena is covered with "Tan" which is a mixture of sand or sawdust, wood shavings, salt and wood bark. It is necessary, at certain intervals of time, to spray water onto the covering mixture and to harrow the mixture to prevent packing of the material and the creation of dust in use of the arena. If the arena is watered by a hand held spray nozzle the water procedure is time consuming and an even distribution of the sprayed water is not always achieved.

A horse riding arena is usually provided around its periphery with outwardly inclined boards so that when a horse moves close to the wall of the arena the rider is not brought into contact with the wall. If automatic spray nozzles are mounted on the walls of the arena then spray water will saturate the inclined boards which causes them to rot and require frequent replacement. If such spray nozzles are mounted on the walls or on the boards then they create protuberances which could seriously injure a rider coming into contact with them.

The present invention provides a spray apparatus which can be mounted on such inclined boards and which can automatically move between an outwardly protruding operational position and a retracted inoperative position.

SUMMARY OF THE INVENTION

This invention relates as aforesaid to spray apparatus and particularly to spray apparatus for spraying water onto the ground or floor area of an arena, such as an indoor horse riding arena.

According to the present invention there is provided spray apparatus comprising a spray or sprinkler unit provided with a pivot mounting and means for moving the spray or sprinkler unit about said mounting, said unit being provided within a container mounted on the unit for movement therewith and means being provided for allowing relative pivotal movement between the spray or sprinkler unit and the container.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail an illustrative embodiment of the invention, this being indicative however of only one way in which the principle of the invention may be employed.

In said annexed drawings.

DESCRIPTION OF THE PREFERRED EMBODIMENT

Figure 1:
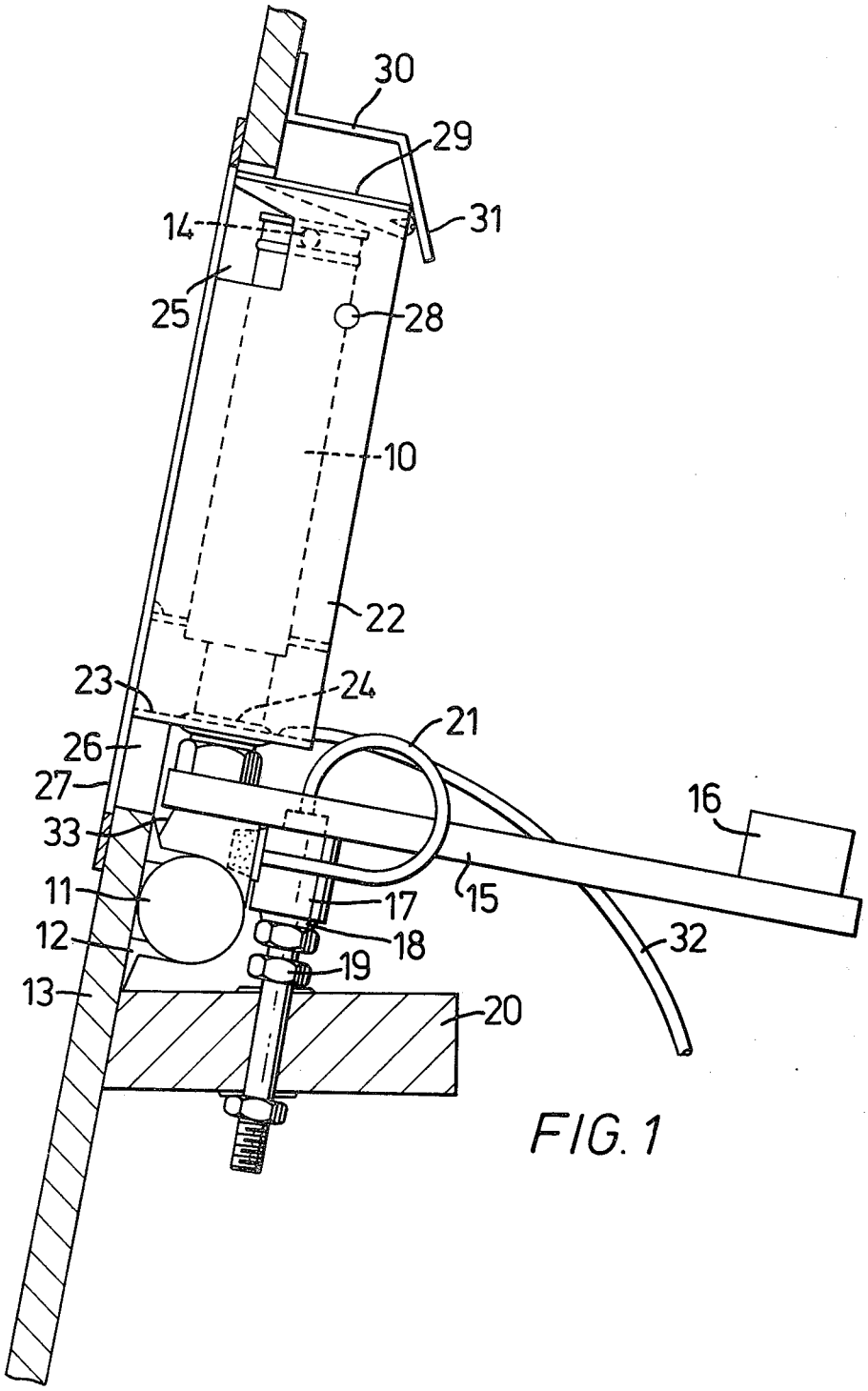
FIG. 1 is a side elevational view of the mounted apparatus in the retracted inoperative position.

The spray apparatus comprises a spray or sprinkler unit 10 which is connected to a transverse conduit 11, the unit 10 being located between the ends of the conduit 11 and each end portion of the conduit 11 is pivotally mounted by a mounting member 12 to the rear side of an inclined board 13 provided at the periphery of a horse riding arena. The conduit 11 is connected to a water supply conduit, not shown. The water supply is preferably via a pump from a static feed tank so that constant water pressure can be achieved. The spray or sprinkler unit 10 has a rotatable spray head provided with side nozzles 14. The spray or sprinkler unit 10 is preferably of the type known as the "Toro" Rain-Pro Sprinkler.

Connected between the unit 10 and the conduit 11 is a metal slide bar 15 to which is adjustably attached a counterweight 16. Fixed to the underside of the bar 15 at its end remote from the weighted end is a hydraulically actuated piston and cylinder device 17. The outer end of the piston 18 of the device 17 contacts an adjustable stop 19 provided on a member 20 fixed to the rear side of the board 13. The device 17 is supplied with water under pressure through a conduit 21 which is connected with the feed conduit to the unit 10.

The unit 10 is housed in a container or shield member 22 which is preferably rectangular in cross-section but which may have any other desired cross-sectional shape. The container 22 has a base 23 provided with a resilient grommet 24 through which the unit 10 extends. The container 22 has an aperture 25 which extends partly along the sides. Preferably the container 22 is provided with an opening along its front side which is closed by a removable cover which when removed gives access to the unit 10. The container 22 is partly received in an opening 26 provided in the board 13 and to the front side of the board 13 is fixed a front cover 27 which surrounds the opening 26.

Each side wall of the container 22 is provided with an outwardly extending stop member 28 which extend beyond the sides of the opening 26. It is of course possible for only one side wall of the container 22 to be provided with a stop member 28.

The top of the container 22 is provided with a lid 29. Fixed to the rear side of the board 13 is an adjustable stop member 30 having an inclined stop portion 31. It will be appreciated that by adjusting the position of the stop member 30 will adjust the distance between the board 13 and the contacted part of the inclined portion 31.

The bottom of the container 22 is provided with a drain conduit 32.

Figure 2:
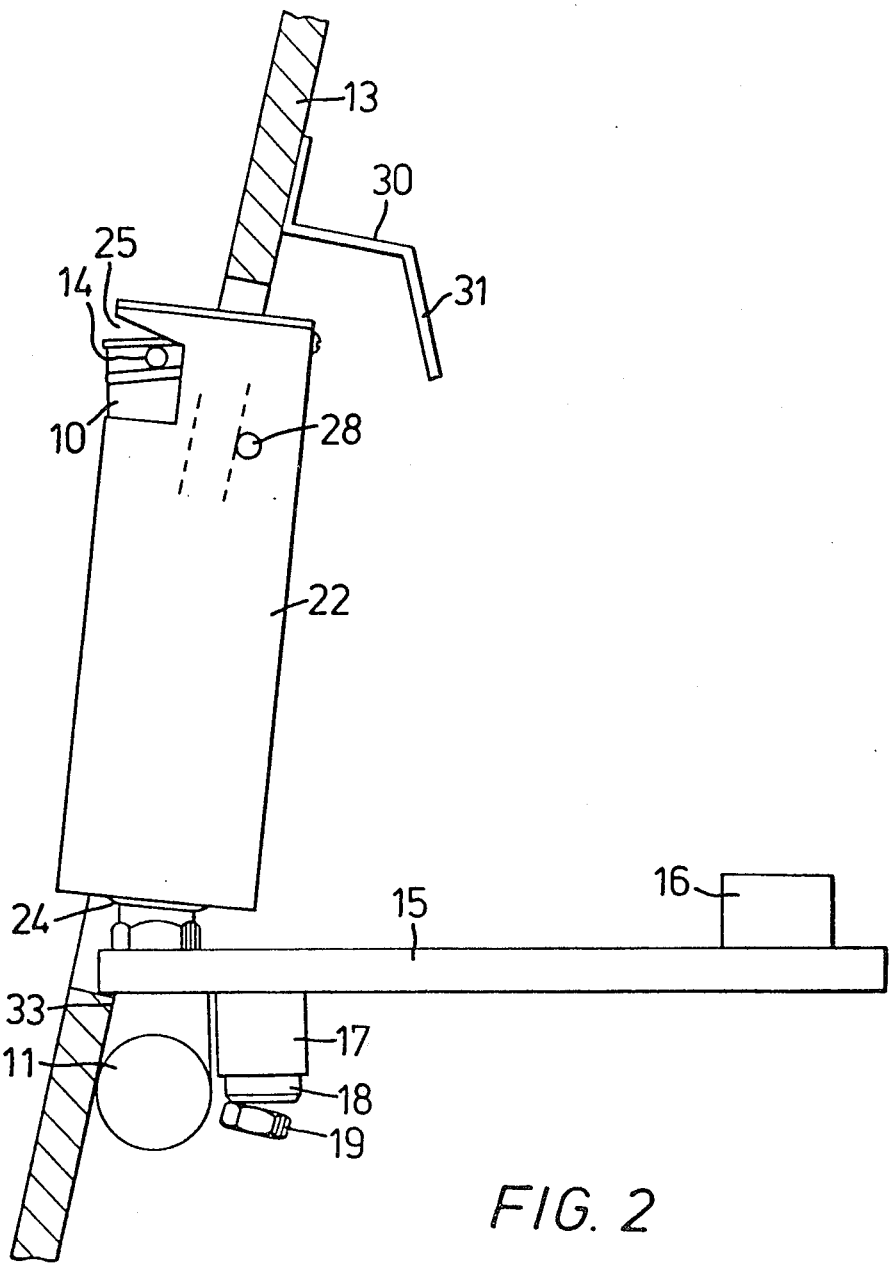
FIG. 2 is a side elevational view of the mounted apparatus in the projecting operative position.

The flow of water to the spray apparatus may be controlled by a manually operated valve or by a remote controlled valve for automatic operation. When the water under pressure is supplied to the sprinkler unit 10 the water will slowly rotate the spray head and be sprayed from the nozzles 14 as they each move around a predetermined arc of movement. The water will simultaneously flow to the piston and cylinder device 17 to cause the piston 18 to be forced against the stop 19 and the cylinder will act on the bar 15 to cause the unit 10 and container 22 to pivot about the axis of conduit 11. During the initial part of this pivoting movement the container 22 pivots with the unit 10 and any water which is sprayed from the nozzles 14 in a sideways direction will be retained in the container 22 and flow to drain via conduit 32. This ensures that no water comes into contact with the rear of the board 13. The stops 28 will come into contact with the rear of the board 13 after an initial degree of pivotal movement has taken place. When the stops 28 contact the rear of the board 13 the pivotal movement of the container 22 is stopped. However, due to the grommet 24 the spray or sprinkler unit 10 continues to pivot about the axis of the conduit 11 until the unit 10 reaches the position shown in FIG. 2 in which the nozzles 14 can spray through the cut away sides of the container 22. This movement of the unit 10 is terminated by an inclined surface 33 on the unit 10 coming into contact with the rear side of the board 13. In this position both the container 22 and unit 10 protrude through the opening 26. The side spray from nozzles 14 is a light spray just sufficient to dampen the outer side of the board 13.

At the completion of spraying the flow of water to the apparatus is cut-off and vented to drain. The counterweight 16 causes the unit 10 and container 22 to pivot about the axis of the conduit 13 in the opposite direction. The rearward pivoting movement of the container 22 is limited by the rear upper end of the container 22 contacting the inclined portion 31 of stop member 30, and the unit 10 will move into the container 22 to the position shown in FIG. 1, this position being determined by the stop 19 and piston device 17.

The position of the counterweight 16 can be adjusted along the bar 15 in order to adjust the operating speed of pivoting movement of the apparatus. The counterweight 16 is also moved to compensate the operational speed of the unit at varying water pressures.

In the inoperative position the unit 10 is located with its front face flush with the front face of the board 13.

It will be appreciated that even though the spray apparatus has been described for use in spraying water over the ground of an arena it can be used for spraying other surfaces.

While the preferred embodiment of the invention has been described, it will be obvious to those skilled in the art that various changes and modifications may be made without departing from the invention as defined in the appended claims.

I, therefore particularly point out and distinctly claim as my invention:

1. Spray apparatus comprising a spray or sprinkler unit provided with a pivot mounting, means for moving the spray or sprinkler unit about said pivot mounting, a housing surrounding said unit and in which the unit is received, and means for pivotally moving the spray or sprinkler unit with respect to the housing, said means for moving the spray or sprinkler unit when initially activated causing said spray or sprinkler unit and said housing to pivot together about said pivot mounting, with further actuation of said means for moving causing said spray or sprinkler unit to pivot with respect to said housing.

2. Spray apparatus as claimed in claim 1, in which the means for pivotally moving the spray or sprinkler unit with respect to the housing comprises a resilient connecting means between the unit and the housing and a stop member provided on the housing.

3. Spray apparatus as claimed in claim 2, in which the resilient connecting means comprises a resilient grommet.

4. Spray apparatus as claimed in claim 1, in which the housing is provided with an opening through which at least part of a spray head of the spray or sprinkler unit can extend when the unit is pivoted in one direction relative to the housing.

5. Spray apparatus as claimed in claim 1, in which the unit is biassed by a weight to an inoperative position and said means for pivotally moving the spray or sprinkler unit about the pivot mounting comprises a piston and cylinder device.

6. Spray apparatus as claimed in claim 5, in which the piston and cylinder device is arranged to receive liquid under pressure through a conduit connected to a feed conduit to the spray or sprinkler unit.

7. Spray apparatus as claimed in claim 1, in which said pivot mounting is mounted on an inclined board provided with an opening through which the unit can be at least partially extended when moved about the pivot mounting in one direction.

8. Spray apparatus as claimed in claim 7 including an adjustable stop member connected with the rear side of the board for limiting the pivotal movement of the unit to its inoperative position.

9. Spray apparatus as claimed in claim 8, in which the front of the housing lies flush with the front face of the board when the unit is in an inoperative position.

10. Spray apparatus as claimed in claim 1, in which the housing is provided with a drain conduit.

11. An arena provided around at least part of its periphery with outwardly inclined boards, at least one spray apparatus as claimed in any preceding claim for spraying water onto the ground or floor area of the arena, and mounting means for mounting the spray apparatus to said boards, said mounting means including said pivot mounting.

* * * * *